US009840386B2

(12) United States Patent
Zhou et al.

(10) Patent No.: US 9,840,386 B2
(45) Date of Patent: Dec. 12, 2017

(54) BANKNOTE SEPARATION DEVICE AND RADIAL LASH ADJUSTING METHOD THEREFOR

(71) Applicant: GRG BANKING EQUIPMENT CO., LTD., Guangzhou, Guangdong (CN)

(72) Inventors: Guihong Zhou, Guangdong (CN); Tianrui Li, Guangdong (CN); Zhan Liu, Guangdong (CN)

(73) Assignee: GRG BANKING EQUIPMENT CO., LTD., Gangzhou, Guangdong (CN)

( * ) Notice: Subject to any disclaimer, the term of this patent is extended or adjusted under 35 U.S.C. 154(b) by 0 days.

(21) Appl. No.: 15/518,433

(22) PCT Filed: Jul. 27, 2015

(86) PCT No.: PCT/CN2015/085188
§ 371 (c)(1),
(2) Date: Apr. 11, 2017

(87) PCT Pub. No.: WO2016/058433
PCT Pub. Date: Apr. 21, 2016

(65) Prior Publication Data

US 2017/0309112 A1 Oct. 26, 2017

(30) Foreign Application Priority Data

Oct. 13, 2014 (CN) ..... 2014 1 0538166

(51) Int. Cl.
*B65H 3/42* (2006.01)
*B65H 27/00* (2006.01)
(Continued)

(52) U.S. Cl.
CPC ..... *B65H 3/42* (2013.01); *B65H 3/063* (2013.01); *B65H 3/0653* (2013.01);
(Continued)

(58) Field of Classification Search
CPC .. B65H 3/42; B65H 2402/31; B65H 2402/62; B65H 2701/20; B65H 27/00
See application file for complete search history.

(56) References Cited

U.S. PATENT DOCUMENTS 4,603,848 A * 8/1986 Markgraf ..... B65H 3/5238 271/125
5,542,571 A * 8/1996 Belka ..... B65G 59/067 221/268

(Continued)

FOREIGN PATENT DOCUMENTS

CN 2494347 Y 6/2002
CN 200953164 Y 9/2007

(Continued)

OTHER PUBLICATIONS

International Search Report for PCT/CN2015/085188, dated Oct. 8, 2015, ISA/CN.

*Primary Examiner* — Patrick Cicchino
(74) *Attorney, Agent, or Firm* — U.S. Fairsky LLP; Yue Xu

(57) ABSTRACT

A banknote separation device includes a banknote separation wheel set and a reverse wheel set. The reverse wheel set includes a reverse wheel component, a reverse wheel set rotation shaft, a first fixing frame and a second fixing frame. Two ends of the reverse wheel set rotation shaft are fixed on two mounting side plates respectively, the first fixing frame and the second fixing frame are respectively fixedly connected at two ends of reverse wheel component. The first fixing frame is provided with two lash adjusting threaded holes and a first lash adjusting screw, the second fixing frame is provided with a second lash adjusting threaded hole and a second lash adjusting screw cooperating therewith, and radial clearances between two ends of the reverse wheel (Continued)

component and the banknote separation wheel set are adjusted respectively by the two lash adjusting screws.

7 Claims, 3 Drawing Sheets

(51) Int. Cl.
*B65H 3/06* (2006.01)
*G07D 13/00* (2006.01)

(52) U.S. Cl.
CPC ..... *B65H 3/0684* (2013.01); *B65H 27/00* (2013.01); *G07D 13/00* (2013.01); *B65H 2301/423* (2013.01); *B65H 2402/31* (2013.01); *B65H 2701/1912* (2013.01)

(56) References Cited

U.S. PATENT DOCUMENTS

| | | | | | |
|---|---|---|---|---|---|
| 5,642,877 | A * | 7/1997 | Green | B65H 3/5238 | 271/124 |
| 6,485,012 | B1 * | 11/2002 | Bakoledis | B65H 1/06 | 271/124 |
| 6,672,587 | B1 * | 1/2004 | Mohringer | B65H 7/12 | 271/259 |
| 7,828,284 | B2 * | 11/2010 | Coret | B65H 3/063 | 271/124 |
| 8,052,145 | B2 * | 11/2011 | Skinner | B65H 3/0638 | 271/262 |
| 9,567,173 | B2 * | 2/2017 | Harris | B65H 3/04 | |
| 2008/0011579 | A1 | 1/2008 | Kim | | |
| 2008/0135183 | A1 * | 6/2008 | Chang | B29C 63/02 | 156/577 |
| 2015/0187159 | A1 | 7/2015 | Yin et al. | | |

FOREIGN PATENT DOCUMENTS

| | | | | |
|---|---|---|---|---|
| CN | 200983174 | Y | 11/2007 | |
| CN | 101097638 | A | 1/2008 | |
| CN | 201288255 | Y | 8/2009 | |
| CN | 201514652 | U | 6/2010 | |
| CN | 201622635 | U | 11/2010 | |
| CN | 102509385 | A | 6/2012 | |
| CN | 102867359 | A | 1/2013 | |
| CN | 103440703 | A | 12/2013 | |
| CN | 104392541 | A | 3/2015 | |
| DE | 29622921 | U1 | 9/1997 | |
| DE | 202009011196 | U1 | 12/2009 | |
| DE | 202013007461 | U1 * | 10/2013 | B65H 35/0026 |
| GB | 2466688 | A | 7/2010 | |
| JP | H0971339 | A | 3/1997 | |
| WO | 9804484 | A1 | 2/1998 | |

* cited by examiner

BANKNOTE SEPARATION DEVICE AND RADIAL LASH ADJUSTING METHOD THEREFOR

This application is a National Phase entry of PCT Application No. PCT/CN2015/085188, filed Jul. 27, 2015, which application claims the benefit of priority to Chinese patent application No. 201410538166.9 titled "BANKNOTE SEPARATING DEVICE AND RADIAL GAP ADJUSTING METHOD THEREFOR", filed with the Chinese State Intellectual Property Office on Oct. 13, 2014, the entire disclosures of which are incorporated herein by reference.

FIELD

The present application relates to financial self-service apparatus technology, and particularly to a banknote separating device and a radial gap adjusting method for adjusting radial gaps between a banknote separating wheel and a reverse wheel of the banknote separating device.

BACKGROUND

In a banknote separating mechanism of a financial self-service apparatus currently, the following two ways are employed generally to maintain banknote separating radial gaps.

(1) A first way: the banknote separating radial gaps are maintained by precision of parts and precision of assembling. The following precisions are required to be maintained in the first way: the coaxality of positions of holes of a reverse wheel component; the coaxality of positions of holes on a left side plate and a right side plate for mounting a banknote separating shaft; the coaxality of positions of holes for mounting a rotating shaft of the reverse wheel component; the parallelism between an axis of the banknote separating shaft and an axis of the rotating shaft of the reverse wheel component in an assembled state.

This way has following advantages: it is not required banknote separating gap adjustment, and the production line is simple and easy to assemble. This way has following disadvantages: due to high requirements on precisions of parts and assembling, the cost for manufacturing the parts are extraordinarily high, which is not favorable for market competition of the product.

(2) A second way: same heights of a left end and a right end of a reverse wheel component is achieved by adjusting an inner hexagonal screw, which allows the banknote separating gaps in the radial direction to have a same width. This way has advantages of low requirement on precision of parts, and low unit price or cost of the parts. This way has disadvantages that the adjustment to a left gap will generate a tiny effect on a right gap. Similarly, the adjustment to the right gap will generate an effect on the left gap. In addition, during the gap adjusting process, it requires a tool or a jig to achieve adjustment precision, and the adjustment process is time consuming and labor consuming, and has a low production efficiency.

SUMMARY

In order to address the issues in the conventional technology that the banknote separating radial gap adjustment has a low production efficiency, a new banknote separating device is provided according to the present application, which tries changing a fixing manner of reverse wheels to lower the cost, improve the production efficiency on the premise of maintaining the assembling easiness, thereby improving market competitiveness of the product.

A banknote separating device is applied in a financial self-service apparatus. The banknote separating device includes a banknote separating wheel set and a reverse wheel set cooperated with the banknote separating wheel set. The reverse wheel set includes a reverse wheel component, a reverse wheel set rotating shaft, a first fixing frame, and a second fixing frame. Two ends of the reverse wheel set rotating shaft are fixed respectively to two mounting side plates in the financial self-service apparatus, and the first fixing frame and the second fixing frame are respectively fixedly connected to two ends of the reverse wheel component. An end, away from the second fixing frame, of the first fixing frame is provided with a first gap adjusting threaded hole, a first gap adjustment stop block extends from the mounting side plate at a side close to the first fixing frame, and the position of the first gap adjustment stop block corresponds to the position of the first gap adjusting threaded hole. A first gap adjusting screw is arranged in the first gap adjusting threaded hole, and a head portion of the first gap adjusting screw is in contact with the first gap adjustment stop block. The second fixing frame is provided with a second gap adjusting threaded hole, a second gap adjustment stop structure extends from an end, close to the second fixing frame, of the first fixing frame, and the position of the second gap adjustment stop structure corresponds to the position of the second gap adjusting threaded hole. A second gap adjusting screw is arranged in the second gap adjusting threaded hole, and a head portion of the second gap adjusting screw is in contact with the second gap adjustment stop structure.

Specifically, the reverse wheel component includes a one-way bearing, a rotating shaft, and at least a pair of reverse wheels, the reverse wheels are sleeved on the rotating shaft, and the one-way bearing allows the reverse wheels to rotate about the rotating shaft in a unidirectional manner.

Specifically, the first fixing frame, the reverse wheel set rotating shaft and the reverse wheel component are fixedly connected into a rigid body.

Specifically, the second fixing frame is further provided with two fastening screw holes configured to mount with fastening screws for fixing the second fixing frame onto the reverse wheel set rotating shaft, which allows the second fixing frame, the reverse wheel set rotating shaft and the reverse wheel component to form a rigid body.

A radial gap adjusting method for the banknote separating device described above, includes: a first step, a second step and a third step. In the first step, the first gap adjusting screw is adjusted to allow the first fixing frame and an end, fixedly connected to the first fixing frame, of the reverse wheel component to move up and down along screw threads of the first gap adjusting screw, and further adjust a radial gap between the end, connected to the first fixing frame, of the reverse wheel component and the banknote separating wheel set. In the second step, the second gap adjusting screw is adjusted to allow the second fixing frame and an end, fixedly connected to the second fixing frame, of the reverse wheel component to move up and down along screw threads of the second gap adjusting screw, and further adjust the radial gap between the end, connected to the second fixing frame, of the reverse wheel component and the banknote separating wheel set, and the radial gap is adjusted to have a same width with the radial gap after being adjusted in the above first step. In the third step, the fastening screws are screwed into the fastening screw holes of the second fixing frame, such that the second fixing frame is secured onto the reverse wheel set rotating shaft.

Preferably, in the first step, the head portion of the first gap adjusting screw is in contact with the first gap adjustment stop block. When the first gap adjusting screw is rotated clockwise, the first fixing frame and the end, fixedly connected to the first fixing frame, of the reverse wheel component move upward along the screw threads of the first gap adjusting screw, which allows the radial gap between the reverse wheel set and the banknote separating wheel set to be increased. When the first gap adjusting screw is rotated counterclockwise, the first fixing frame and the end, fixedly connected to the first fixing frame, of the reverse wheel component move downwards along the screw threads of the first gap adjusting screw, which allows the radial gap between the reverse wheel set and the banknote separating wheel set to be reduced.

Preferably, in the second step, the head portion of the second gap adjusting screw is in contact with the second gap adjustment stop structure. When the second gap adjusting screw is rotated clockwise, the second fixing frame and the end, fixedly connected to the second fixing frame, of the reverse wheel component move upward along the screw threads of the second gap adjusting screw, which allows the radial gap between the end, connected to the second fixing frame, of the reverse wheel component and the banknote separating wheel set to be increased. When the second gap adjusting screw is rotated counterclockwise, the second fixing frame and the end, fixedly connected to the second fixing frame, of the reverse wheel component move downwards along the screw threads of the second gap adjusting screw, which allows the radial gap between the end, connected to the second fixing frame, of the reverse wheel component and the banknote separating wheel set to be reduced.

In the banknote separating device according to the present application, a radial gap adjustment is performed by fine screw threads of the screw through changing the structure of the reverse wheel set, thus the adjustment operation is simple and can be performed without related tools, jigs and projection equipment, and the adjusting efficiency is high, which facilitates improving the producing efficiency, and reducing the production cost and labor cost, and it may have a low precision requirement for each part and have a simple manufacturing process, thereby the unit price of the part is reduced and the cost of the whole machine is reduced, and the market competitiveness of the product is improved.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only some examples of the present application, and for the person skilled in the art, other drawings may be obtained based on these drawings without any creative efforts.

DETAILED DESCRIPTION

For further describing the banknote separating device and the radial gap adjusting method thereof according to the present application, they are described in detail hereinafter in conjunction with drawings.

Figure 1:
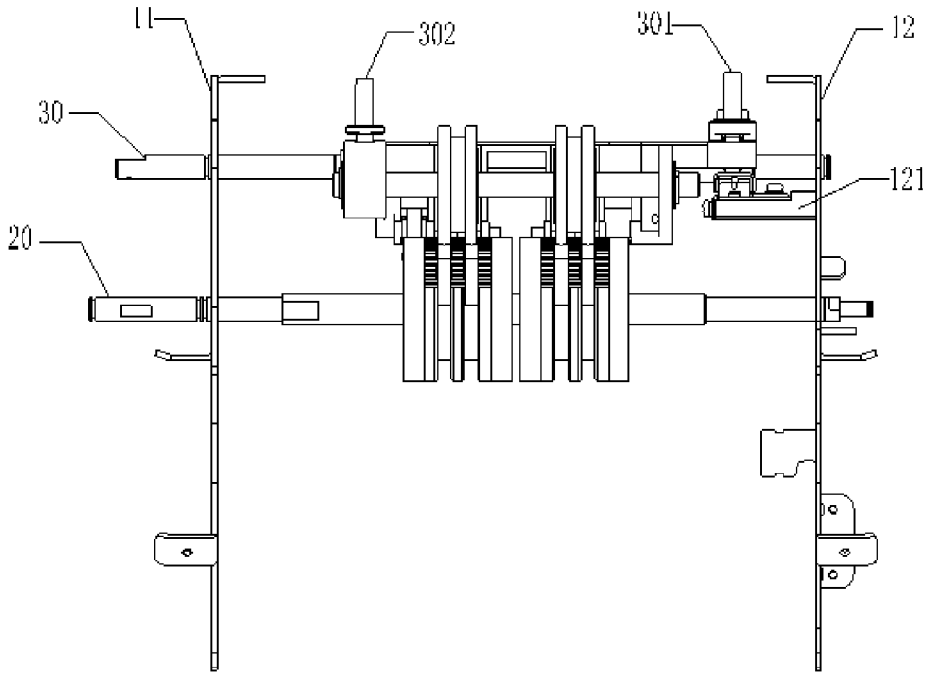
FIG. 1 is a schematic front view showing the structure of a banknote separating device according to a preferred embodiment of the present application.
Figure 2:
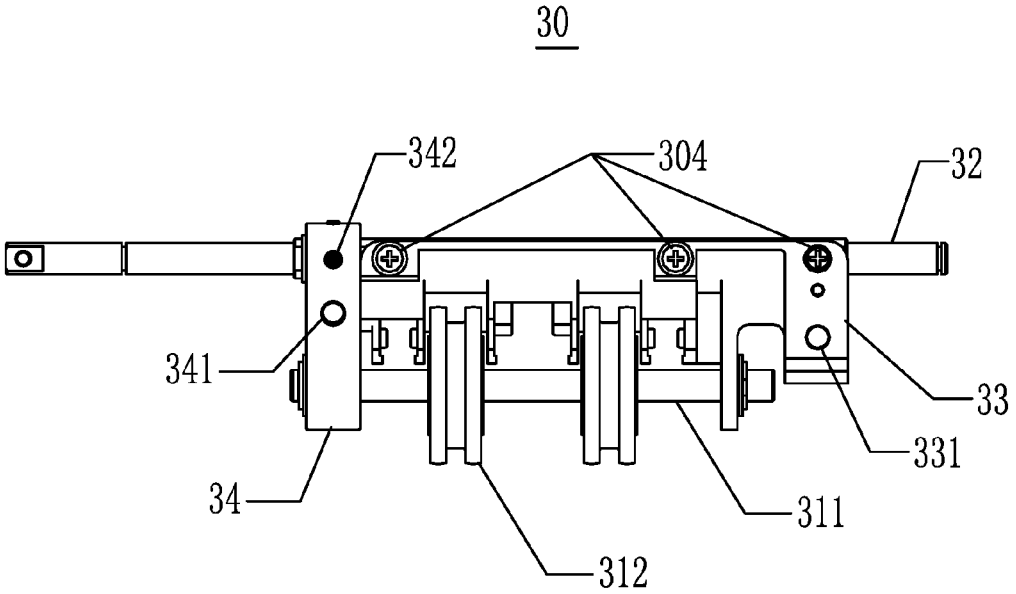
FIG. 2 is a schematic top view of a reverse wheel set 30 in FIG. 1.
Figure 3:
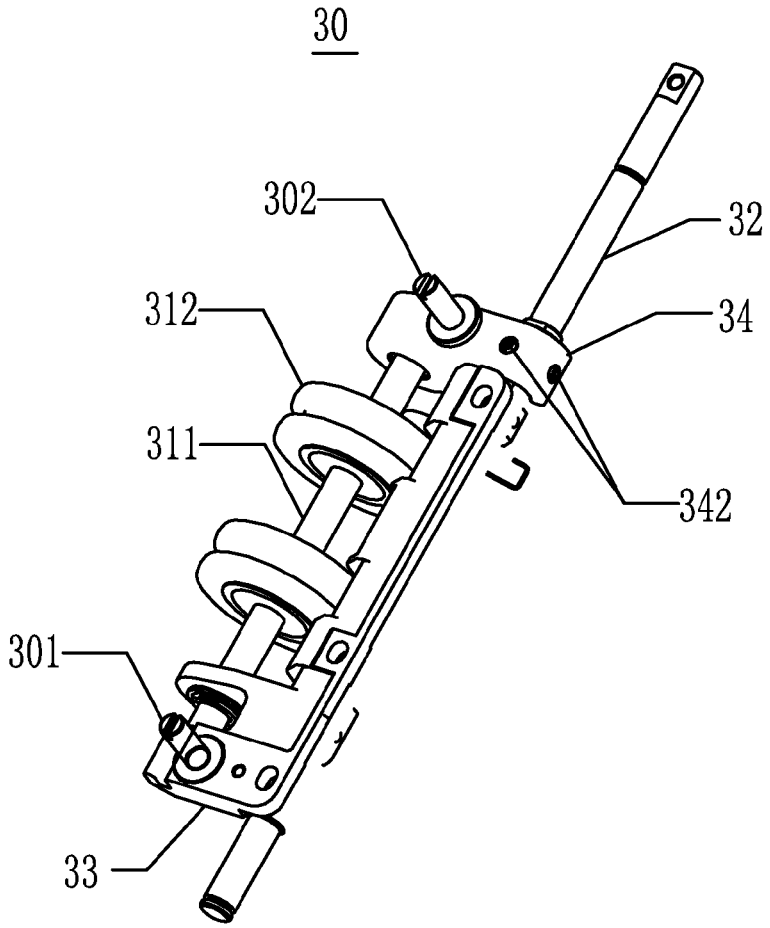
FIG. 3 is a schematic perspective view showing the structure of the reverse wheel set 30 in FIG. 1.
Figure 4:
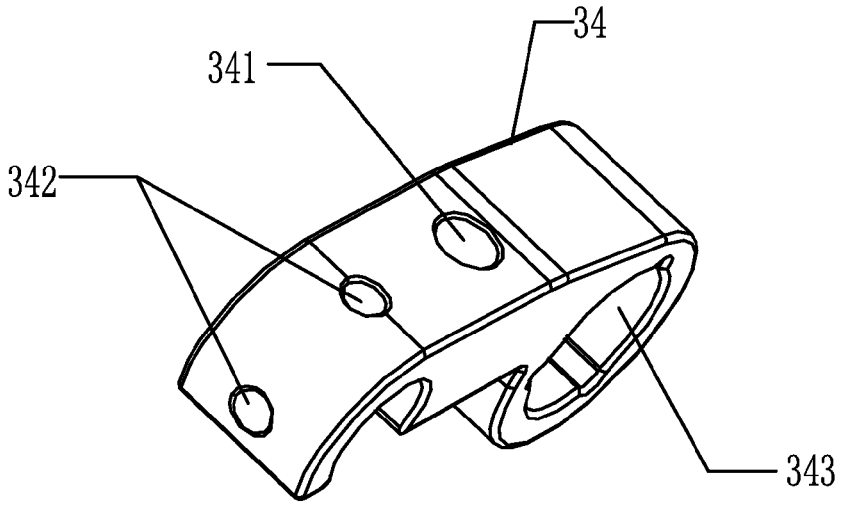
FIG. 4 is a schematic perspective view showing the structure of a second fixing frame in the reverse wheel set 30.
Figure 5:
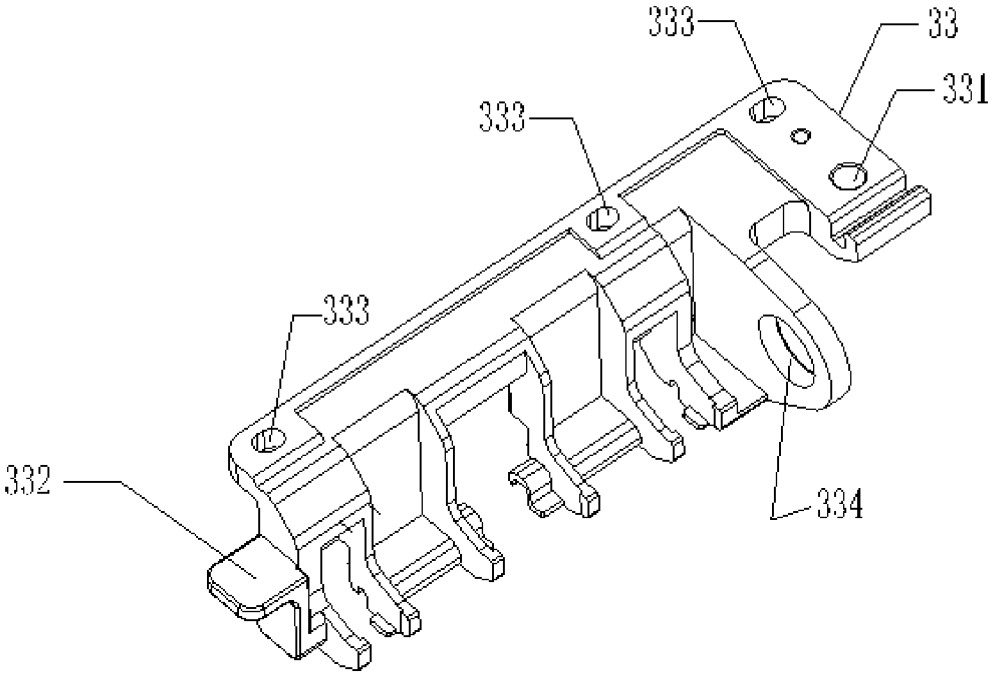
FIG. 5 is a schematic perspective view showing the structure of a first fixing frame in the reverse wheel set 30.

As shown in FIG. 1, a banknote separating device according to an embodiment includes a banknote separating wheel set 20 and a reverse wheel set 30 cooperated with the banknote separating wheel set 20. Two ends of each of the banknote separating wheel set 20 and the reverse wheel set 30 are respectively mounted on mounting side plates 11 and 12. Radial gaps between the banknote separating wheel set 20 and the reverse wheel set 30 are adjusted by a first gap adjusting screw 301 and a second gap adjusting screw 302.

Figure 6:
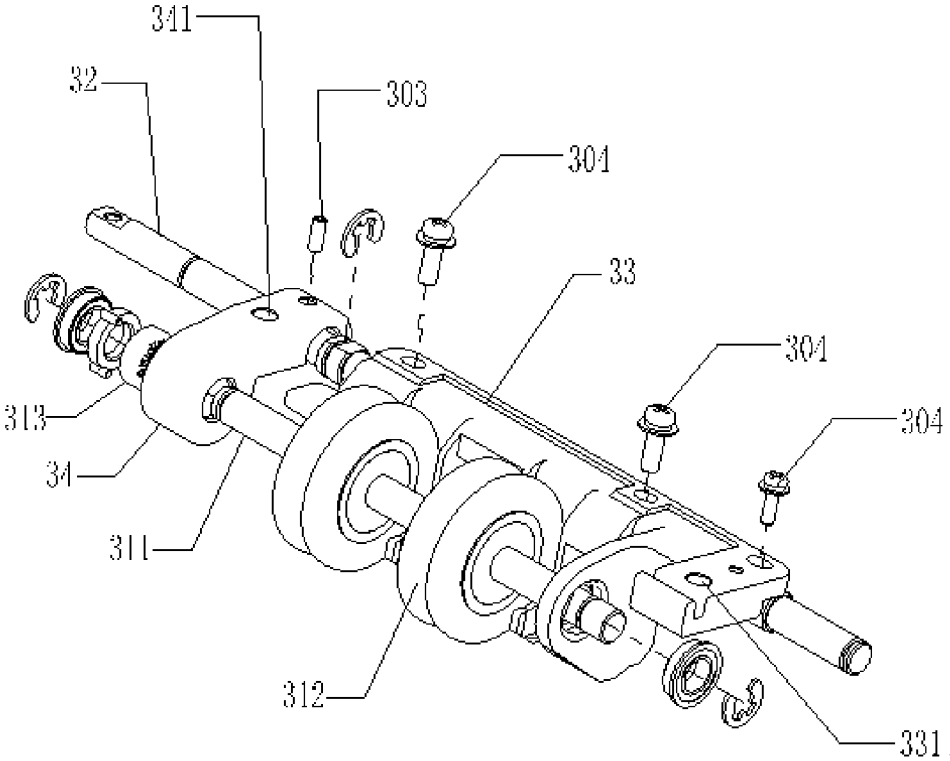
FIG. 6 is an exploded view showing the structure of the reverse wheel set 30.

Specifically, referring to FIGS. 2 to 6, the reverse wheel set 30 includes a reverse wheel component, a reverse wheel set rotating shaft 32, a first fixing frame 33 and a second fixing frame 34. As shown in FIG. 6, the reverse wheel component includes a one-way bearing 313, a rotating shaft 311 and a pair of reverse wheels 312. The reverse wheels 312 are sleeved on the rotating shaft 311, and the one-way bearing 313 allows the reverse wheels 312 to rotate about the rotating shaft 311 in a unidirectional manner. Two ends of the reverse wheel set rotating shaft 32 are respectively fixed on two mounting side plates 11 and 12 in a financial self-service apparatus, and the first fixing frame 33 and the second fixing frame 34 are respectively fixedly connected to two ends of the reverse wheel component. Specifically, the first fixing frame 33 is fixed onto the reverse wheel set rotating shaft 32 by three screws 304. The rotating shaft 311 of the reverse wheel component has one end passing through a fitting hole 334 to be fixedly connected to the first fixing frame 33. Therefore, the first fixing frame 33, the reverse wheel set rotating shaft 32 and the reverse wheel component are fixedly connected to form a rigid body. The rotating shaft 311 of the reverse wheel component has another end passing through a fitting hole 343 of the second fixing frame 34, which achieves fixed connection of the second fixing frame 34 and the reverse wheel component. The second fixing frame 34 is further provided with two fastening screw holes 342 for mounting with fastening screws 303 to fix the second fixing frame 34 onto the reverse wheel set rotating shaft 32, which allows the second fixing frame 34, the reverse wheel set rotating shaft 32 and the reverse wheel component to form a rigid body after a radial gap has adjusted.

For adjusting the banknote separating radial gap, an end, away from the second fixing frame 34, of the first fixing frame 33 is provide with a first gap adjusting threaded hole 331. A first gap adjustment stop block 121 extends from the mounting side plate 12 at a side close to the first fixing frame 33, and the position of the first gap adjustment stop block 121 corresponds to the position of the first gap adjusting threaded hole 331. The first gap adjusting screw 301 is arranged in the first gap adjusting threaded hole 331, and a head portion of the first gap adjusting screw 301 is in contact with the first gap adjustment stop block 121, and reference for the detail may be made to FIG. 1. Further, the second fixing frame 34 is provided with a second gap adjusting threaded hole 341. A second gap adjustment stop structure 332 extends from an end, close to the second fixing frame 34, of the first fixing frame 33, and the position of the second gap adjustment stop structure 332 corresponds to the position of the second gap adjusting threaded hole 341. The second gap adjusting screw 302 is arranged in the second gap adjusting threaded hole 341, and a head portion of the second gap adjusting screw 302 is in contact with the second gap adjustment stop structure 332. By rotating the first gap adjusting screw 301 clockwise or counterclockwise, a radial gap between an end, connected to the first fixing frame 33, of the reverse wheel set 30 and the banknote separating wheel set 20 can be adjusted, and by rotating the second gap adjusting screw 302 clockwise or counterclockwise, a radial gap between an end, connected to the second fixing frame 34, of the reverse wheel set 30 and the banknote separating wheel set 20 can be adjusted. When the radial gaps at the two ends are adjusted to have a same width, the fastening screws 303 are then screwed up, which allows the second fixing frame 34, the reverse wheel set rotating shaft 32 and the reverse wheel component to from a rigid body.

A radial gap adjusting method for the banknote separating device is described in detail hereinafter.

The radial gap adjusting method for the above banknote separating device includes a first step, a second step and a third step. In the first step, the first gap adjusting screw 301 is adjusted such that the first fixing frame 33 and the end, fixedly connected to the first fixing frame 33, of the reverse wheel component move up and down along screw threads of the first gap adjusting screw 301, so as to adjust the radial gap between the end, connected to the first fixing frame 33, of the reverse wheel component and the banknote separating wheel set 20. In the second step, the second gap adjusting screw 302 is adjusted such that the second fixing frame 34 and the end, fixedly connected to the second fixing frame 34, of the reverse wheel component move up and down along screw threads of the second gap adjusting screw 302, so as to adjust the radial gap between the end, connected to the second fixing frame 34, of the reverse wheel component and the banknote separating wheel set 20, and the radial gap is adjusted to have a same width with the radial gap after the adjustment in the first step. In the third step, the fastening screws 303 are screwed into the fastening screw holes 342 of the second fixing frame 34 respectively, such that the second fixing frame 34 is secured onto the reverse wheel set rotating shaft 32.

Specifically, in the first step, the head portion of the first gap adjusting screw 301 comes into contact with the first gap adjustment stop block 121. When the first gap adjusting screw 301 is rotated clockwise, the first fixing frame 33 and the end, fixedly connected to the first fixing frame 33, of the reverse wheel component move upwards along the screw threads of the first gap adjusting screw 301, actually, the second fixing frame 34 and the reverse wheel component rotate upward by a certain angle about the reverse wheel set rotating shaft 32, which allows the radial gap between the reverse wheel set 30 and the banknote separating wheel set 20 to be increased. When the first gap adjusting screw 301 is rotated counterclockwise, the first fixing frame 33 and the end, fixedly connected to the first fixing frame 33, of the reverse wheel component move downwards along the screw threads of the first gap adjusting screw 301, that is, the second fixing frame 34 and the reverse wheel component rotate downwards by a certain angle about the reverse wheel set rotating shaft 32, which allows the radial gap between the reverse wheel set 30 and the banknote separating wheel set 20 to be reduced.

Similarly, in the second step, firstly, it is required that the head portion of the second gap adjusting screw 302 comes into contact with the second gap adjustment stop structure 332. When the second gap adjusting screw 302 is rotated clockwise, the second fixing frame and the end, fixedly connected to the second fixing frame, of the reverse wheel component move upwards along the screw threads of the second gap adjusting screw 302, actually, the second fixing frame 34 and the reverse wheel component rotate upwards by a certain angle about the reverse wheel set rotating shaft 32, which allows the radial gap between the end, connected to the second fixing frame 34, of the reverse wheel component and the banknote separating wheel set 20 to be increased. When the second gap adjusting screw 302 is rotated counterclockwise, the second fixing frame 34 and the reverse wheel component move downwards along the screw threads of the second gap adjusting screw 302, actually, the second fixing frame 34 and the reverse wheel component rotate downwards by a certain angle about the reverse wheel set rotating shaft 32, which allows the radial gap between the end, connected to the second fixing frame 34, of the reverse wheel component and the banknote separating wheel set 20 to be reduced.

In this embodiment, the reverse wheel component is fixed onto the reverse wheel set rotating shaft 32 by the first fixing frame 33 and the second fixing frame 34, and the first fixing frame 33 and the second fixing frame 34 are provided with the first gap adjusting threaded hole 331 and the second gap adjusting threaded hole 341 respectively. Fine adjustments to the radial gaps between the banknote separating wheel set 20 and the two ends of the reverse wheel component are respectively performed by the first gap adjusting screw 301 and the second gap adjusting screw 302, thus the adjustment operation is simple and can be performed without related tools, jigs and projection equipment, and the adjusting efficiency is high, which facilitates improving the producing efficiency, and reducing the production cost and labor cost, and it may have a low precision requirement for each part, and a manufacturing process is simple, thereby the unit price of the part is reduced and the cost of the whole machine is reduced, and the market competitiveness of the product is improved.

The above description is only preferred embodiments of the present application. It should be noted that, the above preferred embodiments should not be deemed as a limitation to the present application, and the scope of the present application is defined by the claims of the present application. For the person skilled in the art, several improvements and modifications may be made to the present application without departing from the spirit and scope of the present application, and these improvements and modifications are also deemed to fall into the scope of the present application.

The invention claimed is:

1. A banknote separating device for a financial self-service apparatus, comprising:

a banknote separating wheel set and a reverse wheel set cooperated with the banknote separating wheel set, wherein the reverse wheel set comprises a reverse wheel component, a reverse wheel set rotating shaft, a first fixing frame, and a second fixing frame, two ends of the reverse wheel set rotating shaft are fixed respectively to two mounting side plates in the financial self-service apparatus, and the first fixing frame and the second fixing frame are respectively fixedly connected to two ends of the reverse wheel component;

wherein an end, away from the second fixing frame, of the first fixing frame is provided with a first gap adjusting threaded hole, a first gap adjustment stop block extends from the mounting side plate at a side close to the first fixing frame, and the position of the first gap adjustment stop block corresponds to the position of the first gap adjusting threaded hole, a first gap adjusting screw is arranged in the first gap adjusting threaded hole, and a head portion of the first gap adjusting screw is in contact with the first gap adjustment stop block; and wherein the second fixing frame is provided with a second gap adjusting threaded hole, a second gap adjustment stop structure extends from an end, close to the second fixing frame, of the first fixing frame, and the position of the second gap adjustment stop structure corresponds to the position of the second gap adjusting threaded hole, a second gap adjusting screw is arranged in the second gap adjusting threaded hole, and a head portion of the second gap adjusting screw is in contact with the second gap adjustment stop structure.

2. The banknote separating device according to claim 1, wherein the reverse wheel component comprises a one-way bearing, a rotating shaft, and at least a pair of reverse wheels, the reverse wheels are sleeved on the rotating shaft, and the one-way bearing allows the reverse wheels to rotate about the rotating shaft in a unidirectional manner.

3. The banknote separating device according to claim 1, wherein the first fixing frame, the reverse wheel set rotating shaft and the reverse wheel component are fixedly connected into a rigid body.

4. The banknote separating device according to claim 3, wherein the second fixing frame is further provided with two fastening screw holes configured to mount with fastening screws for fixing the second fixing frame onto the reverse wheel set rotating shaft, which allows the second fixing frame, the reverse wheel set rotating shaft and the reverse wheel component to form a rigid body.

5. A radial gap adjusting method for a banknote separating device, comprising:

a first step: adjusting the first gap adjusting screw to allow the first fixing frame and an end, fixedly connected to the first fixing frame, of the reverse wheel component to move up and down along screw threads of the first gap adjusting screw, and further adjust a radial gap between the end, connected to the first fixing frame, of the reverse wheel component and the banknote separating wheel set;

a second step: adjusting the second gap adjusting screw to allow the second fixing frame and an end, fixedly connected to the second fixing frame, of the reverse wheel component to move up and down along screw threads of the second gap adjusting screw, and further adjust the radial gap between the end, connected to the second fixing frame, of the reverse wheel component and the banknote separating wheel set, and adjusting the radial gap to have a same width with the radial gap after the adjustment in the first step; and a third step: screwing the fastening screws into the fastening screw holes of the second fixing frame to secure the second fixing frame onto the reverse wheel set rotating shaft.

6. The radial gap adjusting method for the banknote separating device according to claim 5, wherein in the first step, the head portion of the first gap adjusting screw is in contact with the first gap adjustment stop block, and when the first gap adjusting screw is rotated clockwise, the first fixing frame and the end, fixedly connected to the first fixing frame, of the reverse wheel component move upwards along the screw threads of the first gap adjusting screw, which allows the radial gap between the reverse wheel set and the banknote separating wheel set to be increased; and when the first gap adjusting screw is rotated counterclockwise, the first fixing frame and the end, fixedly connected to the first fixing frame, of the reverse wheel component move downwards along the screw threads of the first gap adjusting screw, which allows the radial gap between the reverse wheel set and the banknote separating wheel set to be reduced.

7. The radial gap adjusting method for the banknote separating device according to claim 5, wherein in the second step, the head portion of the second gap adjusting screw is in contact with the second gap adjustment stop structure, and when the second gap adjusting screw is rotated clockwise, the second fixing frame and the end, fixedly connected to the second fixing frame, of the reverse wheel component move upwards along the screw threads of the second gap adjusting screw, which allows the radial gap between the end, connected to the second fixing frame, of the reverse wheel component and the banknote separating wheel set to be increased; and when the second gap adjusting screw is rotated counterclockwise, the second fixing frame and the end, fixedly connected to the second fixing frame, of the reverse wheel component move downwards along the screw threads of the second gap adjusting screw, which allows the radial gap between the end, connected to the second fixing frame, of the reverse wheel component and the banknote separating wheel set to be reduced.

* * * * *